US009415320B2

(12) United States Patent
Hackett

(10) Patent No.: US 9,415,320 B2
(45) Date of Patent: Aug. 16, 2016

(54) KITE FLYING APPARATUS AND METHOD

(71) Applicant: CASTAKITE LLC, Monroe, NY (US)

(72) Inventor: Matthias Hackett, Pawling, NY (US)

(73) Assignee: CASTAKITE LLC, Monroe, NY (US)

( * ) Notice: Subject to any disclaimer, the term of this patent is extended or adjusted under 35 U.S.C. 154(b) by 195 days.

(21) Appl. No.: 14/164,052

(22) Filed: Jan. 24, 2014

(65) Prior Publication Data

US 2015/0108278 A1 Apr. 23, 2015

Related U.S. Application Data

(60) Provisional application No. 61/756,256, filed on Jan. 24, 2013.

(51) Int. Cl.
*A63H 27/08* (2006.01)

(52) U.S. Cl.
CPC ..... *A63H 27/08* (2013.01)

(58) Field of Classification Search
CPC ..... A63H 27/08
USPC ..... 244/155 R; 43/18.1 R, 18.1 CT, 23, 24
See application file for complete search history.

(56) References Cited

U.S. PATENT DOCUMENTS

| | | | | |
|---|---|---|---|---|
| 187,804 | A | 9/1932 | Voss et al. | |
| 203,150 | A | 2/1936 | Porter et al. | |
| 238,847 | A | 11/1945 | Garber et al. | |
| 289,687 | A | 7/1959 | Wetzel et al. | |
| 296,118 | A | 11/1960 | Alford et al. | |
| 3,248,819 | A * | 5/1966 | Stealy | A01K 89/012 242/225 |
| 365,202 | A | 3/1972 | Wong et al. | |
| 4,065,080 | A | 12/1977 | Alison | |
| 4,129,273 | A | 12/1978 | Hill | |
| 4,238,086 | A | 12/1980 | Brimmeier | |
| 5,444,934 | A * | 8/1995 | LaTouche | A01K 87/00 43/18.1 CT |
| 6,578,797 | B2 * | 6/2003 | Fischer | A63H 27/08 244/155 A |
| 7,290,731 | B1 * | 11/2007 | Tabor | A63H 27/002 242/291 |
| 7,454,862 | B2 * | 11/2008 | Markley | A01K 87/08 43/18.1 CT |
| 7,533,484 | B2 * | 5/2009 | Markley | A01K 87/04 43/18.1 HR |
| 8,276,310 | B1 * | 10/2012 | Weber | A01K 97/10 43/17 |
| 8,919,031 | B2 * | 12/2014 | Malcarne | A01K 87/08 43/18.1 CT |
| 2010/0251596 | A1 * | 10/2010 | Malcarne | A01K 87/06 43/18.1 CT |

FOREIGN PATENT DOCUMENTS

JP 2011087897 A 5/2011

* cited by examiner

*Primary Examiner* — Justin Benedik
(74) *Attorney, Agent, or Firm* — Law Offices of Michael L. Wise, LLC

(57) ABSTRACT

An improved kite launching, flying and control apparatus and system combines a target kite with a reel and control arm arrangement for power flexing a kite line under tension to launch the kite, while adjusting, unreeling and retrieving of the kite line with a reel having an integral brake and trigger mechanism, thereby controlling the launch and flight characteristics of the kite.

13 Claims, 8 Drawing Sheets

KITE FLYING APPARATUS AND METHOD

CROSS-REFERENCE TO RELATED APPLICATIONS

This application claims the benefit of co-pending provisional application Ser. No. 61/756,256 filed Jan. 24, 2013 and which is incorporated herein by reference.

FIELD OF THE INVENTION

The invention relates to improved equipment, apparatus and methods for kite flying and kite sporting activities.

BACKGROUND OF THE INVENTION

The art of kite flying from ancient to modern times involves a wide variety of styles and equipment and many improvements over time. Kite flying designs of many types and styles have been provided for both entertainment and sport. Heretofore conventional kite flying rigs have provided entertainment, amusement, sport, play and fun for people of all ages.

Although kite flying can be enjoyed very simply, and without much more than a spool of twine, a large existing variety of reels and spools have been employed for making the activity more efficient and effective.

As kite designs have improved, so has kite line and twine and ever larger spools and reels have been employed. At the other end of the kite market, typical kites are flown for entertainment and simple rigs are used by children and supervising adults.

Thus there is ever a need to provide improved equipment for flying kites in an efficient and entertaining manner. Further, it is desirable to attain, improve and exhibit levels of kite flying skill and performance, and the subject apparatus and method does so to a degree which has not been available previously.

These improvements will be appreciated by experienced kite flying participants as well as beginners.

SUMMARY OF THE INVENTION

The subject apparatus for launching, flying and controlling kites comprises a kite reel housing having a handle at a first end for manually holding and orienting the apparatus. The reel housing contains a kite line spool for storing, releasing or retrieving line as desired, and the spool has a take-up or rewind handle. The spool and reel housing are configured to contain the spool while maintaining a first locked mode which prevents unintended release of kite line. The reel housing has a manual altitude trigger to provide an intentional line-release mode during launching and flying maneuvers. The trigger is preferably integral to the housing or may be attached separately.

Preferably, the release trigger is a cantilevered trigger integral to the reel housing, perhaps molded directly therein, and uses a pawl and ratchet configuration for controlling release of the line. In preferred embodiments, the kite line spool is engaged within the reel housing with friction clips for rotatably maintaining the spool on an axis and permitting free running of line from the spool or to rewind the line when intended by the user.

Accordingly, the reel housing may have a first line guiding eyelet to receive line reeling away from the spool or being retrieved back to the spool, and the eyelet is oriented to direct the line from the reel housing. The eyelet may be molded into the apparatus or may be a cylindrical addition to minimize friction and reduce wear on the line. Also attached to the reel housing is a line control and guide arm which is adjustably and securely attached at a pivot point connected to a second end of the reel housing. The guide arm preferably has an arched (arcuate) configuration to minimize interference with kite line running underneath it toward a target kite. The control and guide arm further comprises a second line guiding eyelet at the opposite or distal end of the apparatus for directing the line toward an intended target.

The terminal end of the kite line is typically a stopper or stopper knot, a kite line connector or the kite itself. A kite line connector is typically a clip or swivel attached to the end of the line for easy attachment to the kite as desired.

In preferred embodiments, the adjustable line control and guide arm and the reel housing will have complementary gear ridges at the pivot point for adjustably securing the arm to the housing. These may be secured by lockable knurled and threaded knob going through one side of the guide arm, frictionally adjoining complementary gear-like ridges on the guide arm and housing and thereafter protruding through the housing for tightening via a complementary threaded nut.

The subject apparatus for launching, flying and controlling kites may be adjustably configured for multiple user-chosen modes of kite flying operation. A neutral first mode of operation maximizes the length of the device when the reel handle, housing and guide arm are maintained in a relatively straight position. A second kite flying operation is possible when the guide arm is positioned above the foregoing neutral position, thereby permitting lifting of the kite line above and away from a target. An additional or third mode of flying operation is possible when the arm is positioned relatively below the aforementioned neutral position, thereby lowering the kite line below the target. These adjustments also contribute to the user's ability to perform kite flying tricks.

As mentioned above, the cantilevered trigger mechanism is configured to hold and release line as desired in varying kite flying conditions. It is contemplated that the apparatus may be configured to further comprise a reel drag mechanism to adjustably permit release of line as desired by the user.

It will be recognized that preferred embodiments of the subject design may comprise a kite flying system or a kite flying kit which may include the above described apparatus as well as the kite line and the kite itself.

Under ideal conditions, the subject apparatus can direct the kite either right or left, upwards and downwards and to and from the user. Combinations of these movements can be utilized for tricks, performances and physical challenges.

The improved apparatus can be utilized with a wide variety or types of kite designs, such as typical diamond shaped paper or plastic kites, usually using tails. These kites will have an attachment point for the kite line and this attachment point will typically be an eyelet, bridal, or strap arrangement for securing the line to the kite. Typically, the line leads from the kite to the participant who typically keeps it on a spool. With the present design, the kite flying participant will be able to influence the kite flying by enabling direction changes, while enjoying the playful action of the kite pulling on the line and influencing the apparatus control and guide arm during the kite flying activity.

The subject design facilitates launching a kite off the ground and launching a kite will be quicker and easier than ever before. The design also allows improved control of the altitude of the kite. Finally, the subject design provides the user with total control over the kite, making it much easier to manipulate the kite's flight path.

Another of the advantages of the subject apparatus is that it is very portable, and it can be manufactured inexpensively.

The improved control and direction of the kite is achieved as described below by the utilization of an adjustable control or guide arm incorporated into a spool and reel housing with a control handle.

For example, launching the kite in low wind conditions is accomplished with the control and guide arm powering the kite and line off the ground, while placing the kite substantially higher in the air off the ground where the wind gusts are stronger and more capable of flying the kite.

The subject improved system may be made and used in accordance with the apparatus and methods described in detail below.

Other objects, features and advantages of the present invention will be apparent when the detailed descriptions of the preferred embodiments of the invention are considered with reference to the accompanying drawings, which should be construed in an illustrative and not limiting sense as follows.

DETAILED DESCRIPTION OF THE PREFERRED EMBODIMENTS

The subject improved apparatus has several important elements as detailed herein below. Connections among elements may include physical and mechanical fasteners and connectors, integrally attached components. Where desired, chemical bonds are provided by suitable adhesives.

Figure 1:
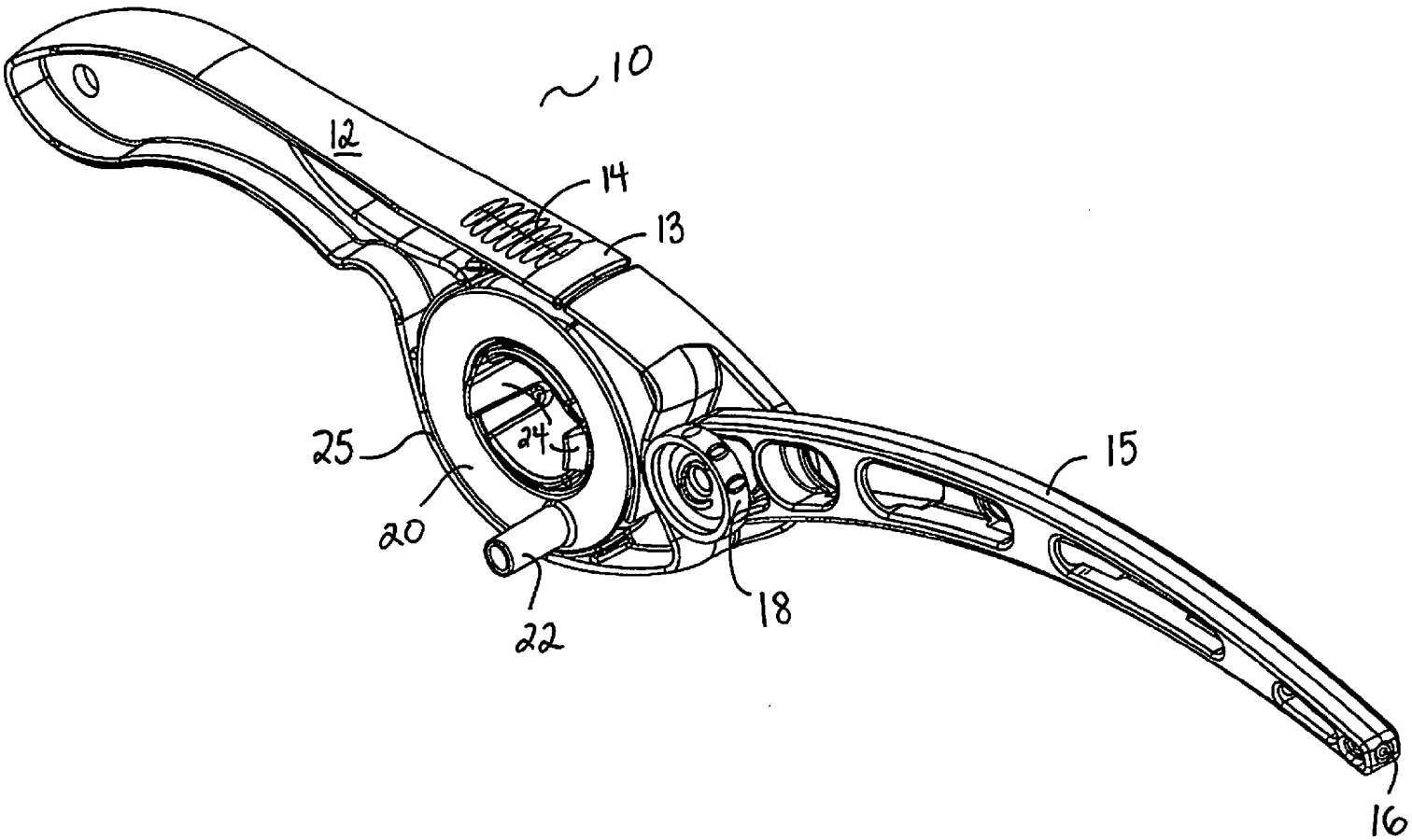
FIG. 1 is a perspective view of a preferred embodiment of the subject apparatus.

FIG. 1 shows the kite flying apparatus 10 having handle 12 with indents for finger positioning 14. Adjustable guide and control arm 15 attaches to the handle 12 with a nut (not seen in this view) and a complementary knurled and threaded adjustment and tightening knob 18. The adjustable guide arm 15 also has a line exit 16 at the distal end of the guide arm 15 for the kite line or string to exit the apparatus. Within the handle 12 is reel housing 25 in which the spool 20 is held by friction clips 24. The spool 20 also has a rewind handle 22 to facilitate the turning of the spool and re-winding a kite string. Also seen in this view is the release trigger 13 which when pressed allows the spool 20 to be released and spin freely to unwind string as wind conditions and a user permits. In this embodiment, the release trigger operates as a pawl or stopper for a complementary ratchet gear on the spool.

Figure 2:
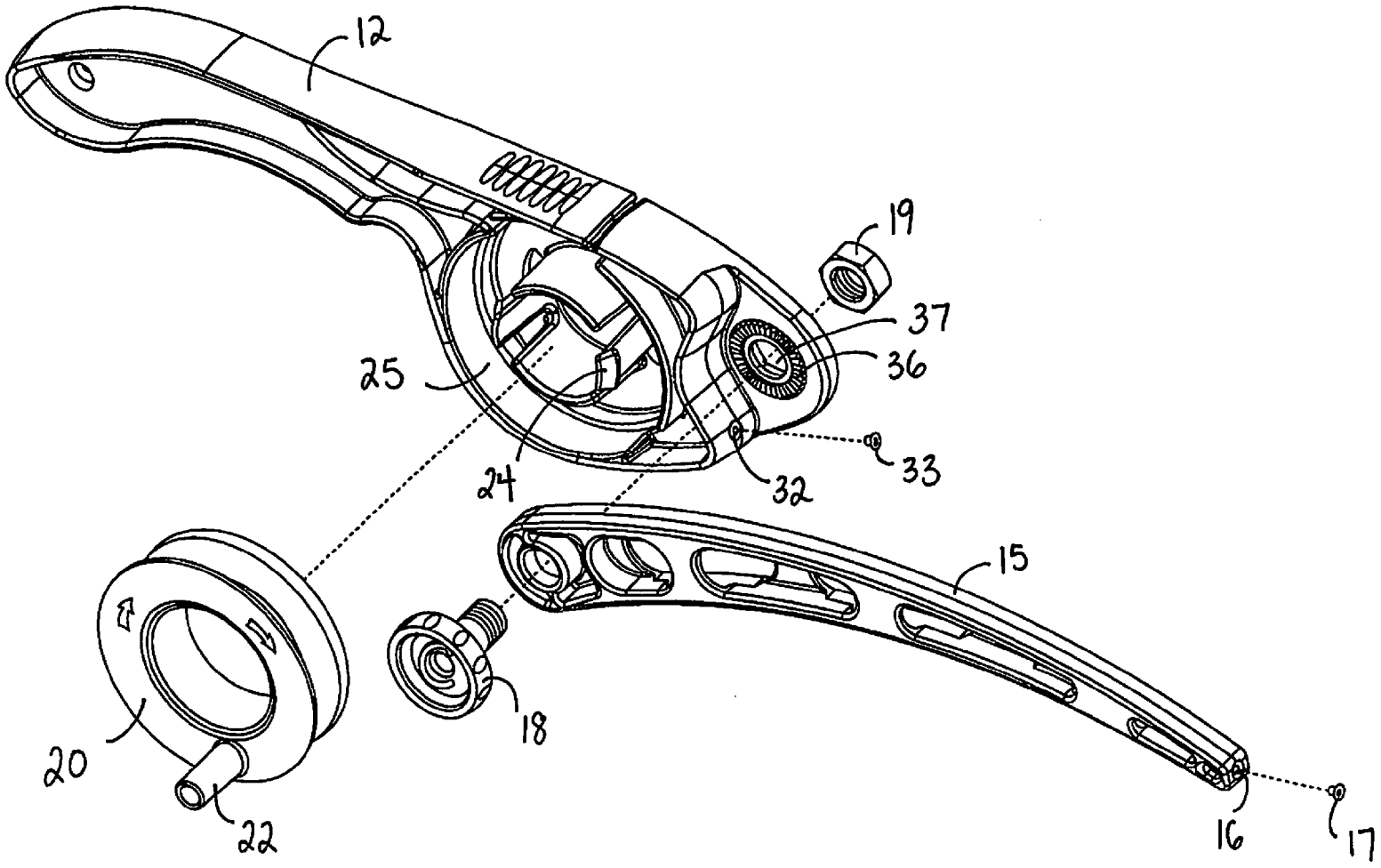
FIG. 2 is an exploded view of the apparatus of FIG. 1.

FIG. 2 is an exploded view of the apparatus of FIG. 1. In this view, the adjustable guide and control arm assembly can more clearly be seen as having the knurled and threaded adjustment and tightening knob 18, adjustable guide arm 15, bolt hole 37, gripping ridges 36, and nut 19. Gripping ridges 36 correspond to similar gripping ridges on the adjustable arm 15 so as to prevent the arm from unintended rotation once the knob 18 is tightened.

Also in this view of the reel housing 25, the line exit 32 and eyelet 33 can be seen, through which the kite string passes after coming off the spool 20. Thereafter, the line passes through the line exit 16 and eyelet 17 at the end of guide arm 15 and the distal end of the apparatus 10.

Figure 3:
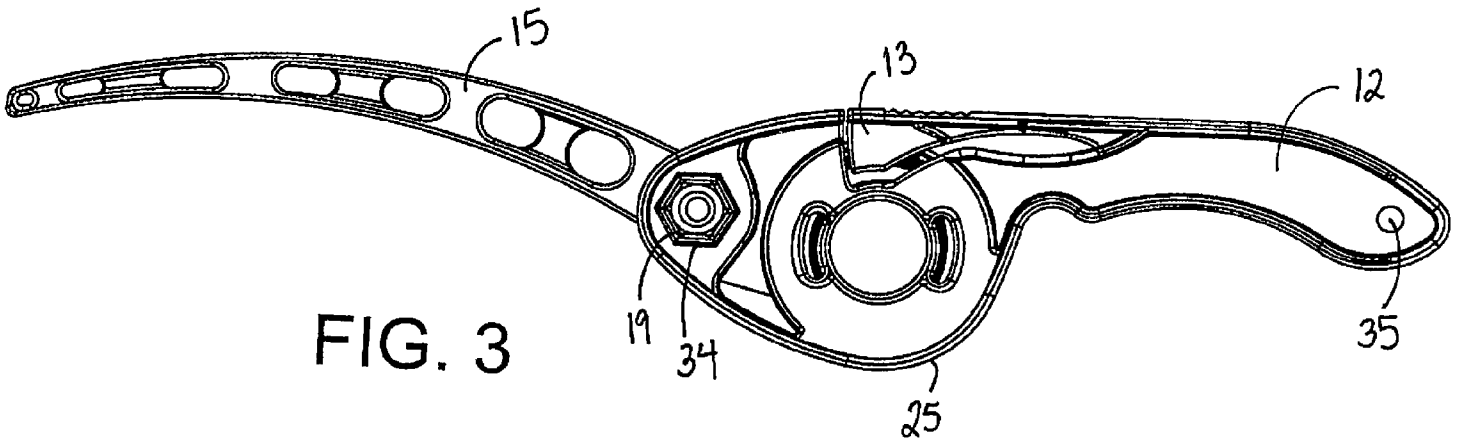
FIG. 3 is a right elevation view of the apparatus of FIG. 1.

FIG. 3 is a right elevation view of the apparatus of FIG. 1. In this view, the nut 19 can be seen within a hexagonal opening 34 built into the housing to prevent the nut from spinning and which facilitates the tightening of the knob 18 and nut 19 without tools. Also, there is a lanyard eyelet 35 through the handle 12, allowing a user to attach a lanyard or other accessory. In this embodiment, handle 12 is shaped to be comfortable when held by the user. Also in this view, the altitude trigger 13 can be seen to protrude down into the reel housing 25 so that when pressed, the pawl (unseen in this view) releases the ratchet mechanism so that the spool is released and the kite line may be let out and controlled as desired.

Figure 4:
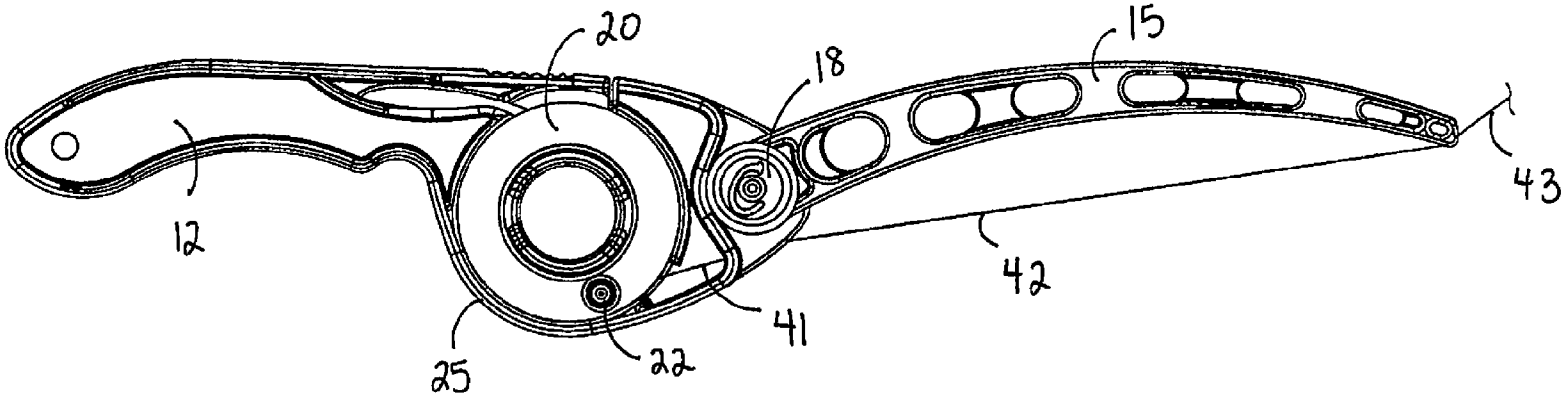
FIG. 4 is a left elevation view of the apparatus of FIG. 1.

FIG. 4 is a left elevation view of the apparatus of FIG. 1. This view illustrates segments of the kite line 41, 42, 43 through the apparatus and as supported and guided by adjustable guide arm 15. The kite line segment 41 unwinds off the spool 20 within the reel housing 25 and passes through kite line exit 32, shown as line exit 32 in FIG. 2. The kite line segment 42 runs from the line exit in the reel housing 25 and handle 12 and passes though the line exit 16 at the distal end of the adjustable guide arm 15. Kite line segment 43 continues from the guide arm 15 to the kite. For storage, line 43 may be detached from a kite and ended with a stopper knot of a kite connecting clip or swivel.

Figure 5:
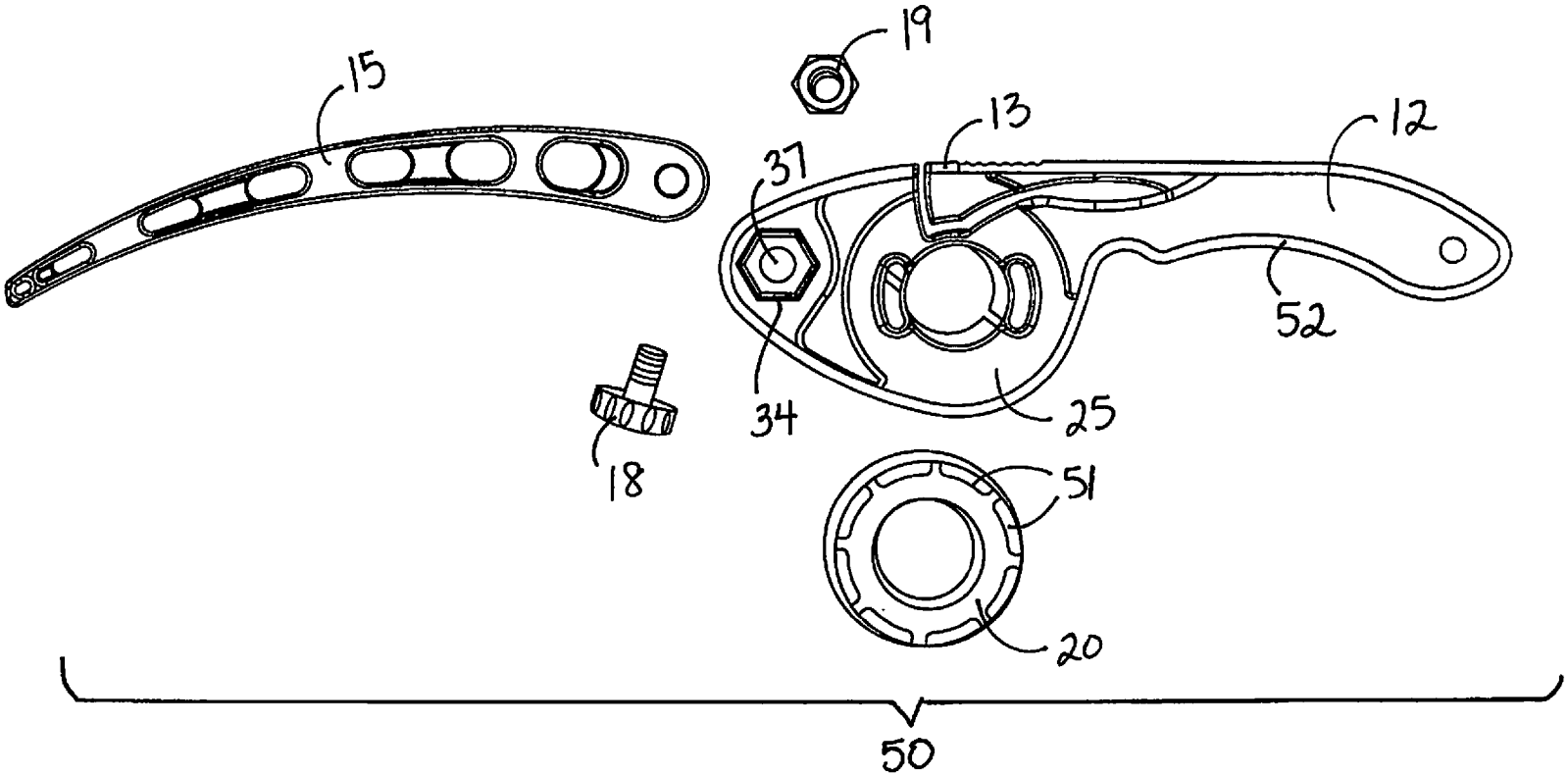
FIG. 5 is a right perspective view of the components of the apparatus of FIG. 1.

FIG. 5 is a right perspective view of the components of the apparatus of FIG. 1. The kit 50 of components of the kite flying apparatus comprises an adjustable guide arm 15, a knurled and threaded adjustment and tightening knob 18, a nut 19, handle 12 and spool 20. In this view of the individual components, the circumferential grooves 51 for the ratchet action of the spool 20 are visible. Also identified in this view is the curvature 52 of the handle 12 that allows a user to comfortably position his fingers to grip the handle 12.

Figure 6:
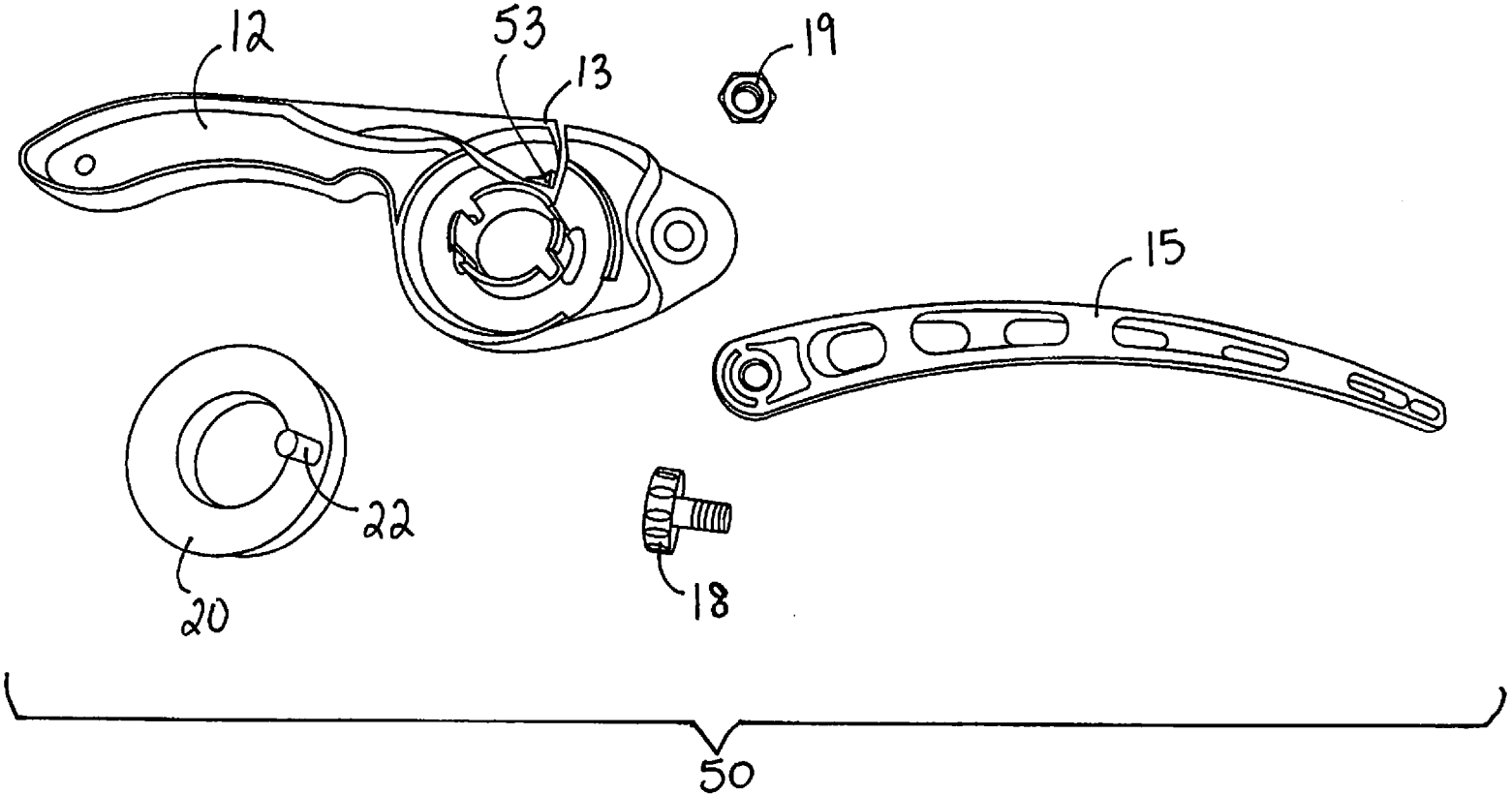
FIG. 6 is a left perspective view of the components of the apparatus of FIG. 1.

FIG. 6 is a left perspective view of the components of the apparatus of FIG. 1. The kit 50 of components comprises the handle 12, the adjustable guide arm 15, the nut 19, the spool 20 having rewind handle 22, and knurled and threaded adjustment and tightening knob 18. In this view, the inside of the reel housing 25 can be seen and shows the pawl 53. The pawl 53 interlocks with the circumferential grooves 51 on the opposite side of the spool 20 to form the ratcheting mechanism, preventing unintended line release and permitting line release as desired by the user.

Figure 7:
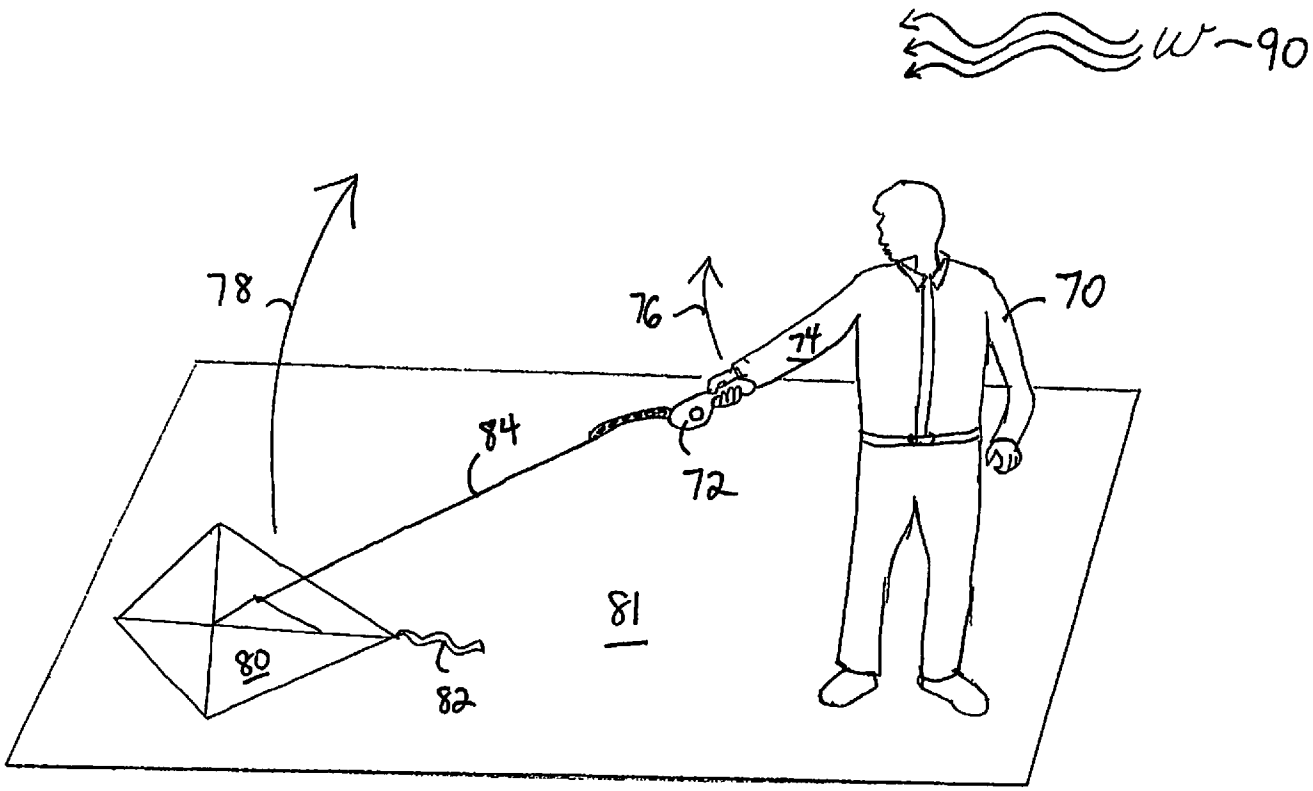
FIG. 7 is a representation of kite launching technique using apparatus of FIG. 1.

FIG. 7 is a representation of kite launching technique using apparatus of FIG. 1. In FIG. 7, a user 70 is shown ready to launch the kite 80. The kite 80 has kite tail 82 and is at rest on the ground 81. In this view, a right-handed user 70 holds the kite flying apparatus 72 in his right hand with his right arm 74 extended toward the resting kite 80 and keeping the kite line 84 taut in preparation for launch. In this example, given the direction of the wind 90 at the time of launch and the desired direction 78 of the kite launch, the user 70 raises his right arm 74 upwards in the direction 76 to launch the kite 80 into the air.

Figure 8:
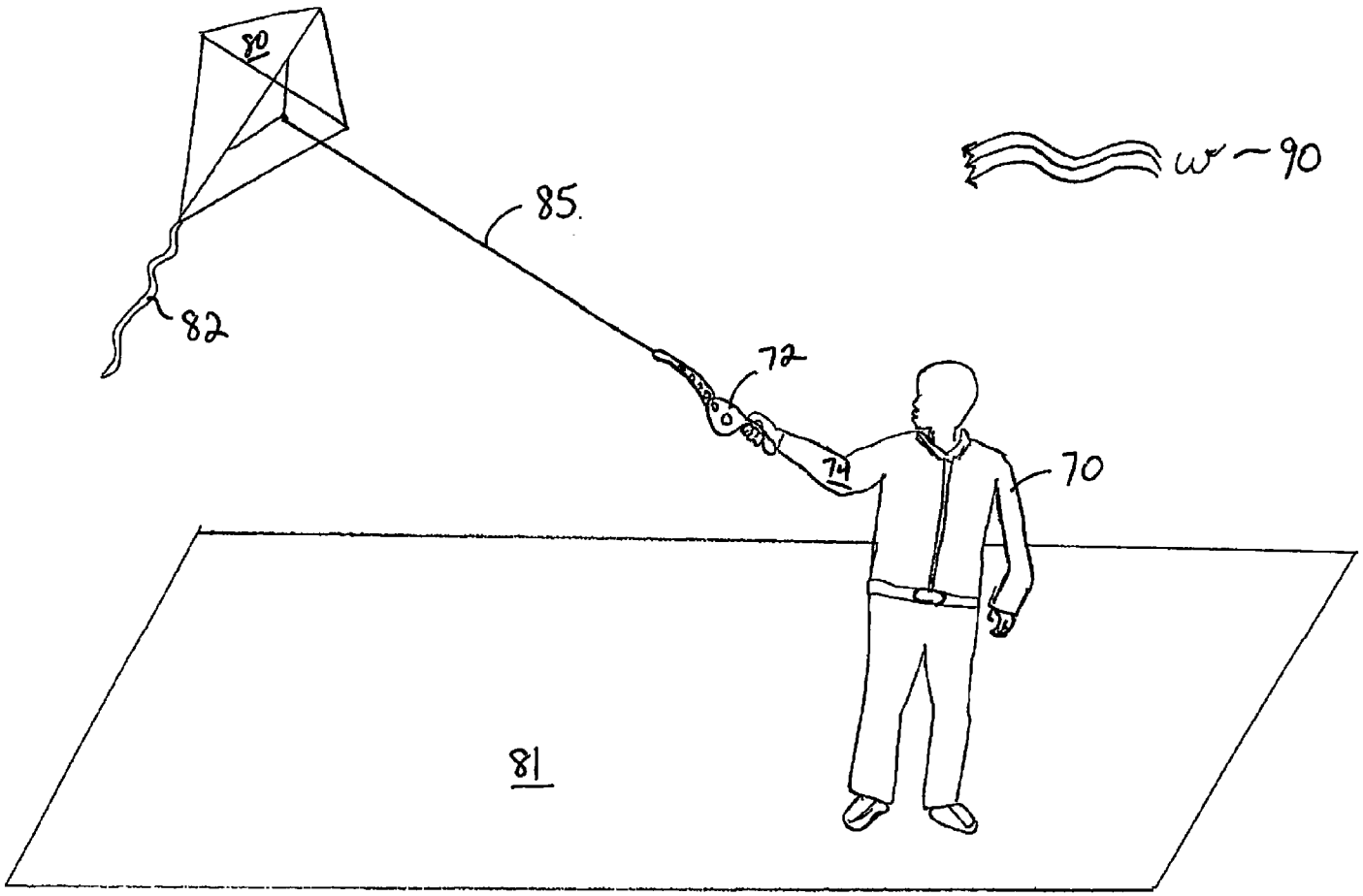
FIG. 8 is a representation of a user in kite flying mode using an embodiment of the subject apparatus.

FIG. 8 is a representation of a user in kite flying mode 71 using the apparatus of FIG. 1. After launching the kite 80 using the technique shown in FIG. 7, a user 70 keeps his arm 74 in a comfortable raised position to maintain kite 80 in the air. In this example, the kite line 85 has been released so that it is lengthened to a length desirable for kite flying.

Figure 9:
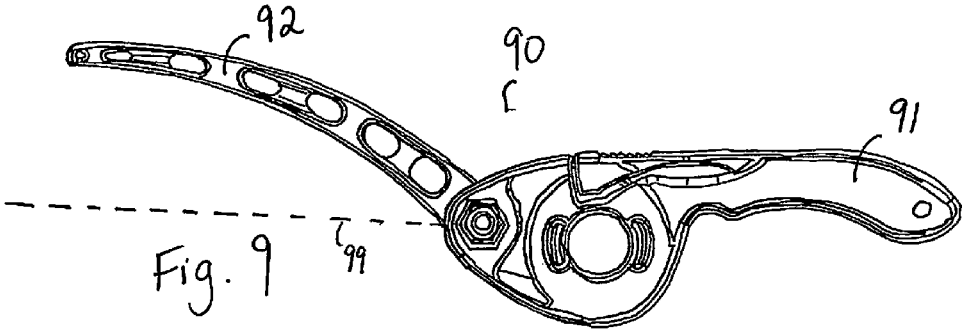
FIGS. 9 and 10 are side elevation views of the apparatus of FIG. 1 with alternative configurations for adjustable fixed arm.
Figure 10:
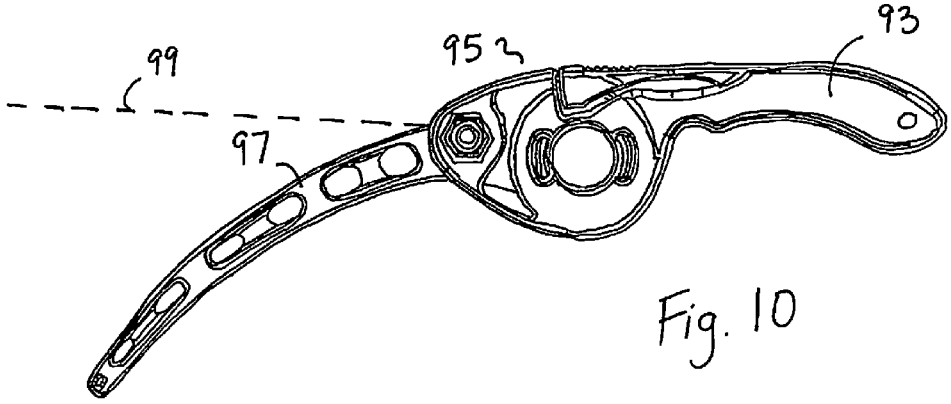

FIGS. 9 and 10 are side elevation views of the apparatus of FIG. 1 with alternative configurations for adjustable fixed arm. As seen in FIG. 8, a user 70 in kite flying mode 71 will hold his arm generally upwards and away from his body when manipulating and flying the kite 80. It may be desirable to change the angle of the adjustable arm so that a user finds a comfortable holding position that also maintains desired control of the kite in flight.

An example of an adjustment to the apparatus 90 is shown in FIG. 9 where the apparatus 90 has the adjustable guide arm 92 moved and fixed in a position above the standard middle or neutral position, denoted by dotted line 99.

A further example of an alternative adjustment to the apparatus 95 is shown in FIG. 10 where the apparatus 95 has the adjustable guide arm 97 moved and fixed in a position below the standard middle or neutral position 99.

Materials for the apparatus handle and spool may be thermoplastic resins molded into the requisite shaped parts. Suitable plastics may include nylons and polyamide blends, high impact plastics such as acrylonitrile-butadiene-styrene (ABS) blends and copolymers such as those known as CYCOLAC® ABS plastics, and polystyrenes; and thermoformable polyolefins. The spool take-up or retrieving handle will also typically be plastic or metal. The spool brake and trigger mechanism can also be a plastic tab, and a metal or plastic spring mechanism may also be utilized to urge or bias the tab into suitable positions. Other reel and spool designs may be substituted without undue experimentation. An integral cantilevered trigger is preferred and a rubber or plastic stopper may be utilized to limit travel of the lever.

The control and guide arm will typically be a resilient plastic or fiberglass arm. In practice, a twenty inch length control apparatus has been found to be satisfactory but other lengths may be utilized as desired for effect. The line guides will typically be metal or plastic eyelets or cylinders.

Altitude control of the kite may utilize a trigger to control the spool and reel in the following fashion. When letting kite line out to increase the altitude of the kite, it is a nuisance to unravel loops of line by hand, so the subject apparatus permits kite line to glide out at different rates at the operator's discretion. The reel can be tightened to prevent any kite line from exiting the reel. However, by loosening the trigger, the wind will pull the kite up and place tension on the kite line, thus pulling more line out.

Further, the control and guide arm can be used for increased control. When the kite is airborne and kite line is let out by loosening the trigger release, various actions are experienced. As the line is tightened, the operator's skill can control the action. By changing the angle of the control arm, the guide will change the tension points and vectors placed upon the kite. This will ultimately manipulate the kite's path.

For example, holding the apparatus in your right hand out and down to the right, the kite will begin to migrate over to where the operator steers it. Using the length of the apparatus rather than just the length of the user's arm allows one to change the angle force applied on the kite. What this creates is much more control over the path of the kite, allowing the user to steer the kite.

Interchangeable control and guide arms can exhibit more or less flex as may be desired for precision flying or just for fun. Typically a lightweight power control arm will give a good combination of these characteristics. Having the control and guide arm offset in relation to the handle and reel housing can also contribute to the utility and flight action of the apparatus.

Using the subject apparatus to fly a kite can employ a wide variety of techniques and actions. A draw and release or draw and reach action has the user pull the apparatus toward himself, away from the kite target, and therefore put tension on the control arm. A release or reach toward the target can either relieve the tension, or facilitate reeling-in on the take-up spool.

Thus varying line tension can create leverage for controlling the control apparatus-kite system. A control arm under line tension with the kite target can act as a center of gravity to influence the action of the flying device. Furthermore, the give and take action of the apparatus in use under tension can be highly enjoyable for the participant.

Another influencing factor is the operation of the spool and reel. Line tension adjustments, as well as differing line retrieval techniques will also influence the kite flying action.

With practice, the user can learn to perform tricks with the flying kite. Or, on a beach or open field, the apparatus can be placed in a holder in the sand or a hole in the ground for hands-free kite flying when wind conditions cooperate.

Example: A kite launching, flying and control apparatus molded of ABS thermoplastic resin in accordance with the description above, was operated in the following fashion.

A user first loaded approximately 150 feet of kite line onto a take up spool. The end of the line was fed through the reel housing or the apparatus and exited the reel housing at an eyelet where it was guided by hand to the far end of an adjustable guide arm where it was then fed through a second eyelet. At this time the line may be secured with a stopper knot or a snap toggle or clip or directly attached to a kite to be flown. In this example, the kite line was attached to a kite.

The spool was then installed in the reel housing of the apparatus and held in the housing by friction clips and secured from unintended rotation by ratchet gears on the spool and a pawl on a release trigger. A desired amount of line was released from the spool by operation of the trigger release with the operator's finger.

When ready to fly the kite, the kite was placed on the ground relatively downwind from where the user intended to stand, and a length of line covering that distance was released from the apparatus as the user returned to his starting flight position. The line was made relatively taut by reeling in excess line and the user aimed his arm, the apparatus and the line directly toward the kite laying on the ground.

At launch the user quickly raised his arm upwards in an arc causing maximum leverage and mechanical advantage to pull on the line and lift the kite off the ground into the prevailing wind. Since there was sufficient wind to fly the kite, additional line was released by the user by pressing the release trigger and the kite soared into the sky.

The user then adjusted his arm to other comfortable positions effective for controlling and flying the kite. The handle variously was held vertically or horizontally, and the adjustable guide arm was adjusted upward or downward as desired for comfort and control.

As desired during kite-flying, the user retrieved portions of the kite line by rotating the spool and reeling in the line. The spool and reel housing ratchet mechanism facilitated the reeling in of the line while preventing the unintended release of too much line.

Additionally, the user's arm movements and associated movements of the apparatus and guide arm was useful for guiding and controlling the kite in varying prevailing conditions. With practice some kite flying tricks were attempted and perfected, such as loops and dips. During the kite flying mode, additional line was released or retrieved as desired.

When the kite flying session was finished, the kite line was readily retrieved at a comfortable pace until the kite was returned to the user.

In the foregoing example, the handle and reel housing, as well as the take-up spool, control and guide arm and the knurled threaded tightening knob were all made of ABS thermoplastic resin. The tightening nut and two metal eyelets were made of steel.

The handle and reel housing was approximately 11.5 inches in length and about 1.0 to 1.2 inches in width. The arched control and guide arm was approximately 10.5 inches in length and 0.2 inches in width. The height was slightly tapered from about 0.5 to 1.0 inches. It utilized an I-beam construction to save material and to provide an aerodynamic shape.

The spool had an approximate outside diameter of 3.0 inches, and an inside diameter of about 1.75 inches defining the center of the spool. The threaded knurled knob had a total length of about 1.4 inches.

The invention now being fully described, it will be apparent to one of ordinary skill in the art that many changes and modifications can be made thereto without departing from the spirit or scope of the invention set forth herein.

The invention claimed is:

1. An apparatus for launching, flying and controlling kites, comprising:

a. a kite reel housing having a handle at a first end for manually holding and orienting the apparatus, the reel housing containing a kite line spool for storing, releasing or retrieving line, the spool having a rewind handle whereby the spool and reel housing are configured to contain the spool, maintain a first locked mode for preventing unintended release of kite line and whereby the reel housing further comprises a manual altitude trigger to provide an intentional line-release mode during launching and flying maneuvers, and wherein the reel housing has a first line guiding eyelet to receive line unreeling from the spool or being retrieved back to the spool, and whereby the eyelet is oriented to direct the line from the reel housing; and b. a line control and guide arm adjustably and securely attached at a pivot point connected to a second end of the reel housing, the guide arm having an arcuate configuration to minimize interference with kite line running there under, the control and guide arm further comprising a second line guiding eyelet at the distal end of the apparatus for directing the line toward an intended target;

wherein the spool rotates about an axis of rotation perpendicular to a direction of travel of the line running under the guide arm when the line is released or retrieved via the spool;

wherein the manual altitude trigger is integral with the reel housing and extends in cantilever fashion from a remainder of the reel housing;

wherein the manual altitude trigger defines a pawl and is configurable to cause the pawl to interlock with ratchet gears on the spool via a ratcheting mechanism as the spool is rotated to retrieve line back to the spool.

2. The apparatus of claim 1 wherein the line is fixated to a kite.

3. The apparatus of claim 1 wherein the kite line spool is rotabaly engaged within the reel housing with friction clips for maintaining the spool on an axis and permitting free run of line from the spool or being rewound thereon when intended by the user.

4. The apparatus of claim 1 wherein the adjustable line control and guide arm and the reel housing have complementary ridges at the pivot point for adjustably securing the arm to the housing thereby preventing unintended rotation of the arm.

5. The apparatus of claim 4 wherein guide arm and reel housing are secured by a lockable knurled and threaded knob protruding through one side of the guide arm, for tightening via a complementary threaded nut, and frictionally adjoining complementary gear-like ridges on the guide arm and housing.

6. The apparatus of claim 1 wherein the guide and control arm is adjustably configured for multiple user-chosen modes of kite flying operation including a neutral first mode of operation for maximizing length of the device.

7. The apparatus of claim 6 wherein the adjustable arm is positioned for a second kite flying operation in a position above the foregoing neutral position for lifting kite line above and away from a target.

8. The apparatus of claim 7 wherein the adjustable arm is positioned for a third kite flying in a position below the foregoing neutral position for lowering the kite line below the target.

9. The apparatus of claim 1 wherein the cantilevered trigger mechanism configured to hold and release line as desired in varying kite flying conditions.

10. The apparatus of claim 9 wherein the release trigger mechanism further comprises a reel drag mechanism to adjustably permit release of line as desired by the user.

11. The apparatus of claim 1 further comprising sufficient kite line for launching and flying a kite.

12. The apparatus of claim 11 further comprising a mechanical attachment at the distal end of the kite line.

13. The apparatus of claim 1 wherein the the line is fixated to a kite by at least one of a knot, a stopper, and a fastening clip.

* * * * *